US005551608A

United States Patent [19]

Moore et al.

[11] Patent Number: 5,551,608

[45] Date of Patent: Sep. 3, 1996

[54] CLOSURE ASSEMBLY WITH TABBED LINER

[75] Inventors: David N. Moore, Plainfield; Jeffrey F. Ullrich, Western Springs, both of Ill.

[73] Assignee: Phoenix Closures, Inc., Naperville, Ill.

[21] Appl. No.: 492,625

[22] Filed: Jun. 20, 1995

[51] Int. Cl.[6] ..... B67D 3/00

[52] U.S. Cl. ..... 222/542; 222/562; 222/565; 220/256; 220/359; 215/232; 215/349

[58] Field of Search ..... 222/480, 542, 222/556, 562, 565, 570, 541.1; 220/212, 253–256, 258, 353, 356, 359, 521, 744; 215/227, 228, 277, 341, 350, 349, 232

[56] References Cited

U.S. PATENT DOCUMENTS

| | | | |
|---|---|---|---|
| 4,187,964 | 2/1980 | Bogart | 222/546 |
| 4,765,499 | 8/1988 | von Reis et al. | 220/256 |
| 4,954,191 | 9/1990 | Delespaul | 156/69 |
| 4,981,229 | 1/1991 | Lanham | 215/232 |
| 5,176,271 | 1/1993 | Painchaud et al. | 215/261 |
| 5,183,171 | 2/1993 | Pherigo | 220/359 |
| 5,184,746 | 2/1993 | Moore et al. | 220/256 |
| 5,494,200 | 2/1996 | Sheffler et al. | 220/256 |

*Primary Examiner*—Andres Kashnikow
*Assistant Examiner*—Philippe Dergkshani
*Attorney, Agent, or Firm*—Welsh & Katz, Ltd.

[57] ABSTRACT

A closure assembly configured for use with a container having a neck with a land surface at its uppermost end defining a mouth. The closure assembly includes a cap, a liner, and a fitment with a dispensing surface dimensioned to span the mouth of the container. A plurality of liner tabs center the liner in the cap during assembly, and retain the liner and the fitment within the cap prior to placing the cap on a container. One or more tabs may extend through slots in the fitment.

10 Claims, 1 Drawing Sheet

CLOSURE ASSEMBLY WITH TABBED LINER

BACKGROUND OF THE INVENTION

The present invention relates to closures for containers and, more specifically, to a closure assembly which includes a tabbed liner.

There are currently numerous types of closure assemblies which include a particular fitment for dispensing the contents of a container. Typical dispensing fitments, such as sifter fitments, are designed to snap onto or otherwise engage the mouth of the container and to remain on the container when a cap is removed. Such fitments are generally included as part of the container package for a variety of liquid and granular or powdered substances. In addition, most container closure assemblies provided with fitments include a liner that spans the mouth of the container to prevent leakage or spoilage of the contents of the container and to indicate tampering.

Frequently the liner, fitment, and cap are sold, distributed and stored separately prior to being placed on the container. It is desirable to have a closure assembly in which the cap, fitment, and liner are assembled, sold, stored, and applied to the container as a unit. It is desirable to have a tabbed liner because a tab facilitates removal of the liner from the mouth of a container. It is also desirable to have a fitment designed to accommodate and cooperate with a liner tab, and to use one or more tabs to removably retain the liner and the fitment in the cap prior to being placed on the container.

SUMMARY OF THE INVENTION

It is therefore an object of the invention to provide a closure assembly in which a fitment and a liner are stored within a cap until being placed on a container.

Another object of the invention is to provide a closure cap, fitment and liner assembly which can be stored, shipped and subsequently applied to a container as a unit.

Another object of the invention is to provide a closure assembly with a tabbed liner.

Another object of the invention is to provide a fitment which is designed to accommodate and cooperate with a liner tab.

Another object of the invention is to provide a closure assembly in which at least one liner tab is used to retain the liner and the fitment in the cap prior to being placed on the container.

In accordance with the present invention, all of these objects, as well as others not herein identified, are achieved. A liner is designed having a plurality of tabs integrally formed thereto. In a closure assembly, a liner and a fitment are retained in a cap, until being placed on a container, due to frictional engagement of properly dimensioned liner tabs with an inner surface of the cap skirt, or due to engagement of the tabs with a securing bead or with threads formed on an inner surface of the cap skirt.

In some embodiments, a fitment has at least one slot in a side portion of the fitment for receiving at least one liner tab. The cooperation between the fitment and the liner makes it easier to remove the liner from the mouth of the container. It also facilitates retention of the liner and the fitment in a cap prior to placing them on a container.

DETAILED DESCRIPTION OF THE INVENTION

Figure 1:
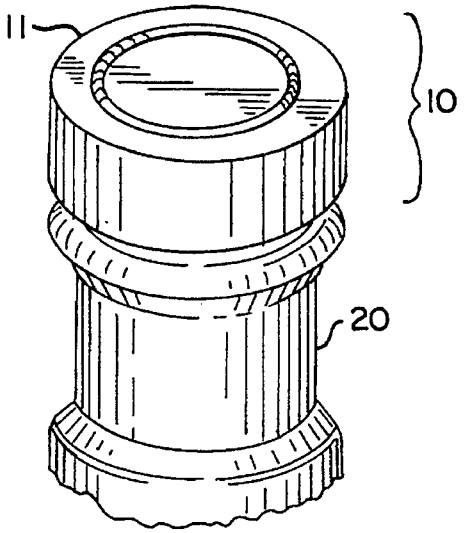
FIG. 1 is a perspective view of a closure assembly shown engaged on a container.
Figure 3:
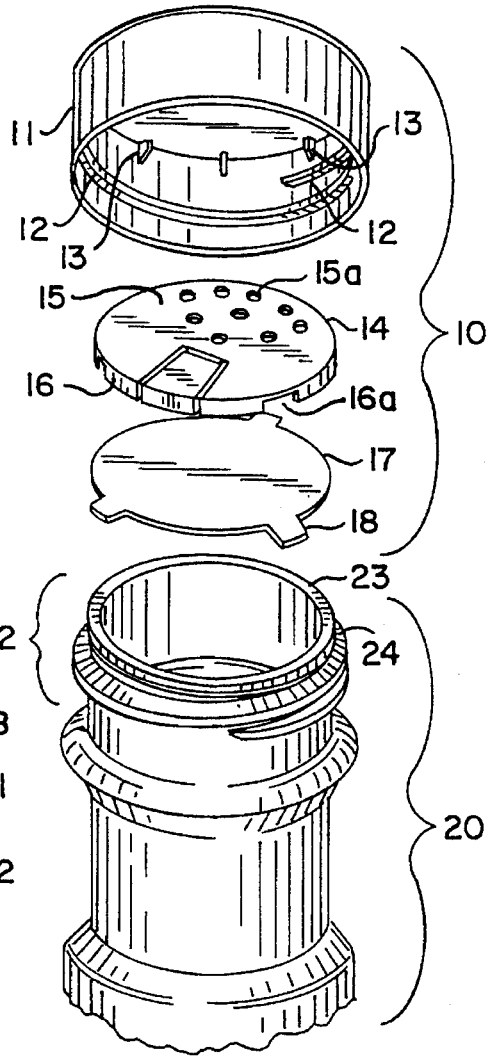
FIG. 3 is an exploded perspective view of the closure assembly of the subject invention showing its use with a container.

In the drawings, 10 designates a closure assembly, which consists essentially of a cap 11, a fitment 14, and a liner 17. The closure assembly 10 is typically designed for use with any type of container 20 used for storing and dispensing a variety of liquid and granular or powdered substances. Although a specific type of container is not required, it is contemplated that the container 20 will include a container neck 22 which may include external threads 24, which are formed integrally on an outer surface of the neck 22, designed to engage complementary threads 12 formed integrally on an inner surface of the cap 11. This is best seen in FIG. 3. It is contemplated the cap 11 will be manufactured of any conventional plastic material used for molded closures, such as polypropylene. It also can have a plurality of centering ribs 13 formed integrally on the inner surface of the cap 11 to center the fitment 14 in the cap 11.

The neck 22 terminates at an uppermost end in a land surface 23 which defines a container mouth. The liner 17 is a two-sided panel which is dimensioned to cover the mouth of the container 20. When applied to the container, the liner 17 prevents spillage, leakage, or spoilage of the contents of the container 20 prior to removal of the liner 17, and also indicates whether tampering has occurred. In applying the liner 17 to the container 20, a bottom surface of the liner 17 is sealed to the land surface 23 by use of an adhesive of a type known in the art for securing a liner 17 to the mouth of a container 20, or by use of other conventional methods such as heat induction or the like. Regardless of the method of sealing used, in a preferred mode the liner 17 is applied to the container 20 along with the cap 11 and fitment 14 in a single step, with the fitment 14 having been retained in the cap 11 by the liner 17 during the time between assembly of the closure assembly 10 and application to the container 20.

Figure 2:
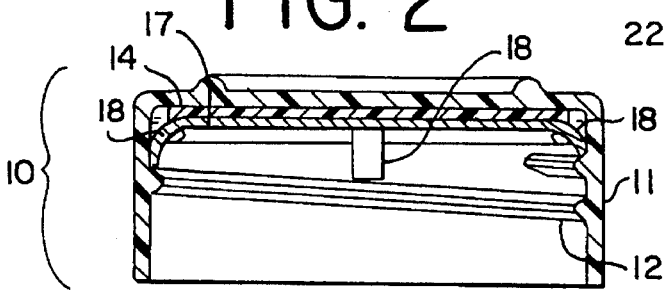
FIG. 2 is a longitudinal sectional view of the closure assembly of the subject invention showing liner tabs cooperating with fitment slots and engaging cap threads.
Figure 4:
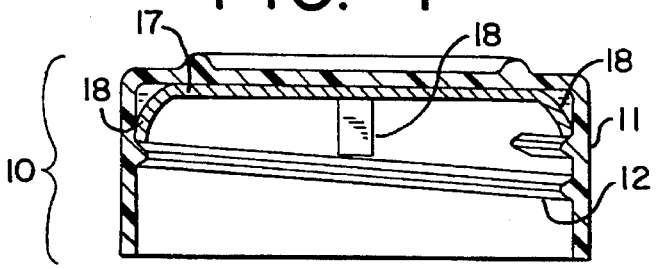
FIG. 4 is a longitudinal sectional view of the closure assembly of the subject invention showing an alternate embodiment without a fitment.
Figure 5:
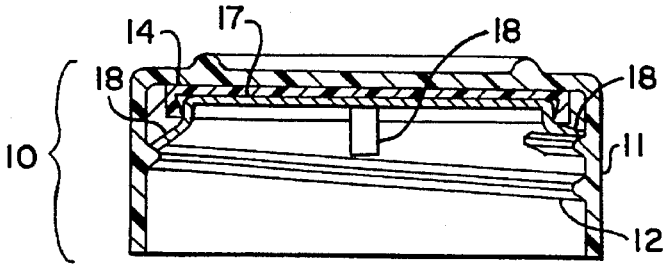
FIG. 5 is a longitudinal sectional view of the closure assembly of the subject invention showing an alternate embodiment without fitment slots.

In one embodiment, the liner 17 has a plurality of tabs 18 integrally formed thereto, as best seen in FIG. 3. The tabs 18 facilitate removal of the liner 17 from the container 20. As part of an entire closure assembly 10, the tabs 18 center the liner 17 in the cap 11 during assembly and are properly dimensioned to engage frictionally an inner surface of the cap 11, or to engage the threads 12 or a securing bead (not shown) on the inner surface of the cap 11, thereby retaining the liner 17 and the fitment 14 in the cap 11 after assembly of the closure assembly 10 and prior to application to the container 20. FIGS. 2 and 5 show the tabs 18 retaining the liner 17 and the fitment 14 in the cap 11 by engagement with the threads 12 on the inner surface of the cap 11. FIG. 4 shows an embodiment without a fitment in which the tabs 18 retain the liner 17 in the cap 11 by engagement with the threads 12 on the inner surface of the cap 11.

The fitment 14 includes a dispensing portion 15 dimensioned to span the mouth of the container 20. There may be a plurality of apertures 15*a* of the same or different sizes in the dispensing portion 15 for dispensing the contents of the container 20. The fitment can also include a side portion 16 to facilitate releasable engagement onto the neck 22 of the container 20.

In one embodiment, there is at least one slot 16*a* in the side portion 16 of the fitment 14 for receiving at least one liner tab 18. The cooperation between the fitment 14 and the liner 17 makes it easier to remove the liner 17 from the mouth of the container 20. As part of an entire closure assembly 10, cooperation between the fitment 14 and the liner 17 also facilitates retention of the liner 17 and the fitment 14 in the cap 11 prior to placing them on the container 20. The slots 16*a* are best seen in FIG. 3. FIG. 2 shows the tabs 18 in cooperation with the slots 16*a*. There are no slots in the fitment 14 in FIG. 5.

While a number of embodiments of the invention have been shown and described, it should be understood that there is no intent to limit the invention by such disclosure, but rather it is intended to cover all modifications and alternative constructions that fall within the spirit and the scope of the invention as defined in the following claims.

What is claimed is:

1. A closure assembly for use with a container, the container having a neck with a land surface at an uppermost end of the neck defining a container mouth, said closure assembly comprising:

a cap having means for releasable engagement of the cap onto the neck of the container;

a liner disposed in said cap, said liner having at least one circumferential tab, and having a top surface and a bottom surface; and a fitment disposed in the cap adjacent the top surface of the liner, said fitment having a dispensing portion spanning the mouth of the container, and having a side portion with at least one slot in said side portion for receiving the at least one tab;

whereby a sealing portion of the bottom surface of the liner can be sealed to the land surface of the neck of the container to cover the mouth of the container.

2. A closure assembly as set forth in claim 1 wherein the cap has a top panel and a skirt depending peripherally from said top panel; and the at least one tab engages an inner surface of the skirt and frictionally and releasably retains the liner and the fitment within the cap.

3. A closure assembly as set forth in claim 1 wherein the cap has a top panel and a skirt depending peripherally from said top panel, and said skirt has an inner surface provided with a securing bead; and the at least one tab engages the securing bead and releasably retains the liner and the fitment within the cap.

4. A closure assembly as set forth in claim 1 wherein the cap has a top panel and a skirt depending peripherally from said top panel;

the means for releasably engaging the cap onto the neck comprises threads formed integrally on an inner surface of the skirt which cooperate with threads formed integrally on an outer surface of the neck; and the at least one tab engages the threads on the inner surface of the skirt and releasably retains the liner and the fitment within the cap.

5. A closure assembly as set forth in claim 1 wherein the dispensing portion of the fitment has a plurality of apertures for dispensing contents of the container.

6. A closure assembly as set forth in claim 1 wherein the cap has a top panel and a skirt depending peripherally from said top panel, and a plurality of centering ribs are formed integrally on an inner surface of the skirt for centering the fitment in the cap.

7. A fitment and liner assembly for use with a container, the container having a neck with a land surface at an uppermost end of the neck defining a container mouth, said fitment and liner assembly comprising:

a liner having a plurality of circumferential tabs, and having a top surface and a bottom surface; and a fitment adjacent the top surface of the liner, said fitment having a dispensing portion spanning the mouth of the container, and having means for releasable engagement of the fitment onto the neck of the container;

whereby a sealing portion of the bottom surface of the liner can be sealed to the land surface of the neck of the container to cover the mouth of the container.

8. A fitment and liner assembly as set forth in claim 7 wherein the dispensing portion of the fitment has a plurality of apertures for dispensing contents of the container.

9. A fitment and liner assembly for use with a container, the container having a neck with a land surface at an uppermost end of the neck defining a container mouth, said fitment and liner assembly comprising:

a liner having at least one tab, and having a top surface and a bottom surface; and a fitment adjacent the top surface of the liner, said fitment having means for releasable engagement of the fitment onto the neck of the container, having a dispensing portion spanning the mouth of the container, and having a side portion with at least one slot in said side portion for receiving the at least one tab;

whereby a sealing portion of the bottom surface of the liner can be sealed to the land surface of the neck of the container to cover the mouth of the container.

10. A fitment and liner assembly as set forth in claim 9 wherein the dispensing portion of the fitment has a plurality of apertures for dispensing contents of the container.

* * * * *